US009365789B2

(12) United States Patent
Yoshida et al.

(10) Patent No.: US 9,365,789 B2
(45) Date of Patent: Jun. 14, 2016

(54) DIALKYL ETHER, AND LUBRICANT BASE OIL AND LUBRICATING OIL COMPOSITION CONTAINING THE SAME

(71) Applicant: IDEMITSU KOSAN CO., LTD., Chiyoda-ku (JP)

(72) Inventors: Yukio Yoshida, Sodegaura (JP); Miki Monoi, Sodegaura (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 62 days.

(21) Appl. No.: 14/136,397

(22) Filed: Dec. 20, 2013

(65) Prior Publication Data

US 2014/0187459 A1 Jul. 3, 2014

(30) Foreign Application Priority Data

Dec. 27, 2012 (JP) ..... 2012-285617

(51) Int. Cl.
*C10M 107/34* (2006.01)
*C10M 171/00* (2006.01)
*C10M 105/18* (2006.01)

(52) U.S. Cl.
CPC ..... *C10M 105/18* (2013.01); *C10M 2205/0285* (2013.01); *C10M 2207/0406* (2013.01); *C10N 2220/022* (2013.01); *C10N 2220/028* (2013.01); *C10N 2230/02* (2013.01); *C10N 2240/04* (2013.01); *C10N 2240/10* (2013.01)

(58) Field of Classification Search
CPC ..... C10M 105/18
USPC ..... 508/579
See application file for complete search history.

(56) References Cited

U.S. PATENT DOCUMENTS

| | | | | |
|---|---|---|---|---|
| 4,515,711 | A | 5/1985 | Chalk et al. | |
| 6,011,071 | A | 1/2000 | Fujii et al. | |
| 2006/0166844 | A1 | 7/2006 | Egawa et al. | |
| 2006/0199747 | A1 | 9/2006 | Kamimura et al. | |
| 2007/0225180 | A1 * | 9/2007 | Tamoto | 508/362 |
| 2013/0074398 | A1 | 3/2013 | Brock-Nannestad et al. | |

FOREIGN PATENT DOCUMENTS

| | | | |
|---|---|---|---|
| GB | 813855 | A | 5/1959 |
| JP | 48-39507 | A | 6/1973 |
| JP | 49-12746 | A | 2/1974 |
| JP | 57-117596 | A | 7/1982 |
| JP | 59-80622 | A | 5/1984 |
| JP | 09-087223 | A | 3/1997 |
| JP | 2003-119285 | A | 4/2003 |
| JP | 2005-344017 | A | 12/2005 |
| JP | 2007-2237 | A | 1/2007 |
| JP | 2012-106948 | A | 6/2012 |
| WO | WO 2004/058928 | A1 | 7/2004 |
| WO | WO 2004/090082 | A1 | 10/2004 |
| WO | WO 2006/025253 | A1 | 3/2006 |
| WO | WO 2011/150924 | A1 | 12/2011 |

OTHER PUBLICATIONS

Japanese Office Action issued Sep. 9, 2014, in Japan Patent Application No. 2014-526027.
Wilhelm Schlenk Jr., "Konfigurativ Stetige Gitterzuordnung der Gastmolekule" (Configurationally Continuous grid assignment of guest molecules) Liebigs Ann. Chem. 1973, pp. 1156-1178 (with English Abstract).
International Search Report and Written Opinion issued Apr. 8, 2014 in PCT/JP2013/084829 (with English Translation of Category of Cited Documents).
C.V. Viswanathan, et al., "Separation of ether homologues by adsorption thin-layer chromatography", J. Chromatog., vol. 30, 1967, pp. 237-239.
Piero Salvadori, et al., "The Optical Rotatory Dispersion of some Dialkyl Ethers Containing a Secondary Butyl Group", Tetrahedron Letters, vol. 6, No. 22 , 1965, pp. 1641-1648.
Misako Obama, et al., "Densities, Molar Volumes, and Cubic Expansion Coefficients of 78 Aliphatic Ethers", Journal of Chemical and Engineering Data, vol. 30, No. 1, 1985, pp. 1-5.
Zi-jiao Yan, et al., "Study of composition and emergency toxicology test of thymus", Science and Technology of Food Industry, Shipon Gongye Keji, vol. 32, No. 2, (2011), pp. 144-146, 276 (with English abstract).
Philip H. Howard, et al., "Identifying New Persistent and Bioaccumulative Organics Among Chemicals in Commerce", Environmental Science & Technology, vol. 44, No. 7, (2010), pp. 2277-2285.
Takeshi Yamamoto, et al., "Olfactory study on optically active citronellyl" Flavour and Fragrance Journal, vol. 19 , No. 2, (2004), pp. 121-133.
Angela Jenisch-Anton, et al., "Biodegradation of a high molecular weight aliphatic ether—indications of an unusual biodegradation pathway", Biodegradation, vol. 10, No. 6 , (1999), pp. 383-392.
Nick Nikolaides, et al., "Conversion of Amines to Phospho Esters: Decyl Diethyl Phosphate", Organic Syntheses, vol. 72, (1995), pp. 246-251.
Edward H. Sharman, et al., "Circular Dichroism Spectra of Aliphatic Ethers", Journal of the Chemical Society, Chemical Communications, vol. 22, 1979, pp. 1000-1001.

(Continued)

*Primary Examiner* — Prem C Singh
*Assistant Examiner* — Francis C Campanell
(74) *Attorney, Agent, or Firm* — Oblon, McClelland, Maier & Neustadt, L.L.P

(57) ABSTRACT

The invention provides a dialkyl ether represented by the following formula (1):

(1)

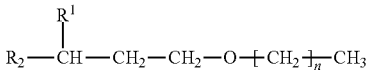

(wherein each of $R^1$ and $R^2$ represents a C1 to C20 alkyl group, and n is an integer of 1 to 20), and a lubricating base oil and a lubricating oil composition containing the dialkyl ether. The lubricating base oil and the lubricating oil composition exhibit low viscosity, excellent viscosity-temperature characteristics, and high fluidity at low temperature.

15 Claims, No Drawings

(56) References Cited

OTHER PUBLICATIONS

S. A. Vartanyan, et al., Zhurnal Obshchei Khimii, 25, 1955, pp. 109-114.

Office Action issued Sep. 8, 2015 in Japanese Patent Application No. 2014-264682 (with English language translation).

H. Boelens, et al., "Chemical structure and odor" American Perfumer and Cosmetics, vol. 83, No. 11, Nov. 1968, 6 pages (with cover page).

Fritz Sigmund, et al., "Uber die katalytische Spaltung von Azetalen an Aluminiumoxyd II" Monatshefte fuer Chemie, Jul. 1931, 8 Pages (with cover page).

Lawrence W. Devaney, et al., "Preparation and Properties of some Octyl Ethers" Journal of the American Chemical Society, vol. 75, Oct. 5, 1953, pp. 4836-4837 (with cover page).

Charles Morel, "The Essentials of Perfume Compounding" Soap, Perfumery and Cosmetics, vol. 27, Feb. 1954, pp. 169-176 (with cover page).

A. I. Lebedeva, et al., " "СИНТЕЗ., КАТАЛИТИЧЕСКОЕ ГИДРИРОВАНИЕ И ГИДРОГЕНОАИЗ НЕПРЕДЕЛЬНЫХ | ПРОСТЫХ ЭФИРОВ" " Zhurnal Obshchei Khimii, vol. 27, 1957, 4 Pages (with cover page).

* cited by examiner

DIALKYL ETHER, AND LUBRICANT BASE OIL AND LUBRICATING OIL COMPOSITION CONTAINING THE SAME

BACKGROUND OF THE INVENTION

1. Field of the Invention

The present invention relates to a dialkyl ether, and to a lubricating base oil and a lubricating oil composition containing the dialkyl ether.

2. Background Art

In recent years, $CO_2$ emission has been required to be reduced more and more from the viewpoint of protection of the global environment. Under such circumstances, there is demand for a drastic improvement in fuel-saving performance of lubricating oil. For attaining fuel savings, reduction of viscous resistance is an effective measure, and a variety of low-viscosity lubricating base oils have been developed. Hitherto, (1) ester, (2) poly-α-olefin, (3) silicone oil, and the like have been developed as low-viscosity lubricating base oils. However, these lubricating base oils have the following problems.

Specifically, when used in an engine oil, ester (1), having high polarity, adversely affects organic parts, resulting in swelling of rubber sealing parts. Poly-α-olefin (2) does not affect organic parts, but difficulty is encountered in establishing suitable balance between viscosity index and pour point (flowability at low temperature), when the viscosity thereof is reduced. Silicone oil (3) has low viscosity and high viscosity index, and exhibits excellent flowability at low temperature. However, silicon oil has problems including poor lubricity and poor compatibility with existing additives.

In order to solve these problems, there has recently been developed a lubricating base oil which contains a compound having an ether bond and which exhibits a kinematic viscosity at 40° C. and an aniline point falling within specific ranges (see Patent Document 1).

It is true that a lubricating base oil containing a compound having an ether bond has low viscosity and high viscosity index, exhibits excellent flowability at low temperature, and is highly compatible to organic parts, thereby enabling use in a lubricating oil such as an engine oil for an internal combustion engine or the like. However, in order to meet needs for further improved fuel-saving performance, such a lubricating base oil must attain a further reduced viscosity and well-balanced viscosity-temperature characteristics and flowability at low temperature.

Specifically, the lubricating base oil disclosed in Patent Document 1 exhibits a kinematic viscosity, as measured at 100° C., of 3.2 to 2.4 $mm^2/s$. In this case, the lower the viscosity, the lower the viscosity index. Currently, there has not been clearly elucidated the structure of the ether compound which enables to attain well-balanced viscosity index and low-temperature flowability of the base oil when the viscosity thereof is further reduced. Patent Documents 2 and 3 disclose a lubricating base oil containing a monoether. However, the disclosed alkyl group combinations at both ends are limited. Patent Documents 4 to 7 and Non-Patent Document 1 disclose monoether compounds, but do not disclose a monoether that can improve viscosity index and flowability at low temperature or a lubricating base oil containing the monoether.

Patent Document 1: WO 2004/058928

Patent Document 2: WO 2004/090082

Patent Document 3: Japanese Patent Application Laid-Open (kokai) No. 2005-344017

Patent Document 4: Japanese Patent Publication (kokoku) No. 1974-12746

Patent Document 5: Japanese Patent Application Laid-Open (kokai) No. 1973-039507

Patent Document 6: Japanese Patent Application Laid-Open (kokai) No. 1982-117596

Patent Document 7: Japanese Patent Application Laid-Open (kokai) No. 1997-087223

Non-Patent Document 1: Wilhelm Schlenk Jr., "Konfigurativ Stetige Gitterzuordnung der Gastmolekule," Liebigs Ann. Chem. 1973, 1156-1178

SUMMARY OF THE INVENTION

The present invention has been conceived in view of the foregoing. Thus, an object of the present invention is to provide an ether which exhibits low viscosity, excellent viscosity-temperature characteristics, and high fluidity at low temperature. Another object is to provide a lubricating base oil and a lubricating oil composition containing the ether.

The present inventors have conducted extensive studies at attain the objects, and have found that the objects can be attained by a dialkyl ether having a specific branch position and a specific combination of end alkyl groups.

Accordingly, in one aspect of the present invention, there is provided a dialkyl ether represented by the following formula (1):

[F1]

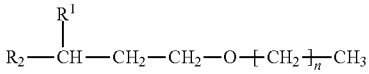

(1)

(wherein each of $R^1$ and $R^2$ represents a C1 to C20 alkyl group, and n is an integer of 1 to 20).

$R^2$ in formula (1) may be a C3 to C10 branched alkyl group; more specifically, a 2,2-dimethylpropyl group or a 4-methylpentyl group.

$R^1$ in formula (1) may be a C1 to C3 linear-chain alkyl group; more specifically, a methyl group.

The "n" in formula (1) may be an integer of 7 to 20; more specifically, 7 to 12, further specifically, 9 to 11.

The alkyl ether may have 30 or fewer carbon atoms in total.

The alkyl ether may have an aniline point of 40° C. or higher, a flash point of 140° C. or higher, or a pour point of 0° C. or lower.

In another aspect of the present invention, there is provided a lubricating base oil comprising at least one member selected from dialkyl ethers represented by the following formula (1):

[F2]

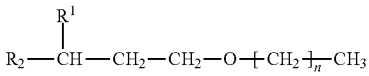

(1)

(wherein each of $R^1$ and $R^2$ represents a C1 to C20 alkyl group, and n is an integer of 1 to 20).

The lubricating base oil may have a kinematic viscosity, as measured at 100° C., of 5.0 $mm^2/s$ or lower, and a viscosity index of 150 or higher.

The lubricating base oil may have a pour point of 0° C. or lower; more specifically, −25° C. or lower.

The lubricating base oil may further contain a hydrocarbon compound. The hydrocarbon compound is a poly-α-olefin.

In still another aspect of the present invention, there is provided a lubricating oil composition comprising the lubricating base oil and an additive.

The lubricating base oil may be for use in a drive system or in an internal combustion engine.

The present invention enables provision of an ether which exhibits low viscosity, excellent viscosity-temperature characteristics, and high fluidity at low temperature, and a lubricating base oil and a lubricating oil composition containing the ether.

DETAILED DESCRIPTION OF PREFERRED EMBODIMENT

[Dialkyl Ether]

The dialkyl ethers falling within the scope of the present invention are represented by the following formula (1):

[F3]

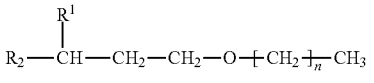

(1)

(wherein each of $R^1$ and $R^2$ represents a C1 to C20 alkyl group, and n is an integer of 1 to 20).

Examples of the alkyl group of $R^1$ and $R^2$ in formula (1) include linear-chain and branched alkyl groups.

Examples of the linear-chain alkyl group include methyl, ethyl, n-propyl, n-butyl, n-pentyl, n-hexyl, n-heptyl, n-octyl, n-nonyl, and n-decyl.

Specific examples of the branched alkyl group include isopropyl, 1-methylpropyl, 2-methylpropyl, t-butyl, 1,1-dimethylpropyl, 2,2-dimethylpropyl, 1,2-dimethylpropyl, 1-ethylpropyl, 2-ethylpropyl, 1,1-diethylpropyl, 1-methylbutyl, 2-methylbutyl, 3-methylbutyl, 1,1-dimethylbutyl, 2,2-dimethylbutyl, 3,3-dimethylbutyl, 1,3,3-trimethylbutyl, 1-ethylbutyl, 2-ethylbutyl, 3,3-dimethylbutyl, 1-propylbutyl, 1-methylpentyl, 2-methylpentyl, 3-methylpentyl, 4-methylpentyl, 4,4-dimethylpentyl, 1-ethylpentyl, 2-ethylpentyl, 3-ethylpentyl, 4-ethylpentyl, 1-propylpentyl, 2-propylpentyl, 1-butylpentyl, 1-methylhexyl, 2-methylhexyl, 3-methylhexyl, 4-methylhexyl, 5-methylhexyl, 5,5-dimethylhexyl, 1-ethylhexyl, 2-ethylhexyl, 3-ethylhexyl, 4-ethylhexyl, 1-propylhexyl, 2-propylhexyl, 3-propylhexyl, 1-butylhexyl, 2-butylhexyl, 1-methylheptyl, 2-methylheptyl, 3-methylheptyl, 4-methylheptyl, 5-methylheptyl, 6-methylheptyl, 6,6-dimethylheptyl, 1-ethylheptyl, 2-ethylheptyl, 3-ethylheptyl, 4-ethylheptyl, 5-ethylheptyl, 1-propylheptyl, 2-propylheptyl, 3-propylheptyl, 1-methyloctyl, 2-methyloctyl, 3-methyloctyl, 4-methyloctyl, 5-methyloctyl, 6-methyloctyl, 7-methyloctyl, 7,7-dimethyloctyl, 1-ethyloctyl, 2-ethyloctyl, 3-ethyloctyl, 4-ethyloctyl, 5-ethyloctyl, 6-ethyloctyl, 1-methylnonyl, 2-methylnonyl, 3-methylnonyl, 4-methylnonyl, 5-methylnonyl, 6-methylnonyl, 7-methylnonyl, 8-methylnonyl, and 3,5,5-trimethylhexyl.

$R^1$ is preferably a C1 to C3 linear-chain alkyl group, and $R^2$ is preferably a C3 to C10 branched alkyl group, more specifically, a 2,2-dimethylpropyl group or a 4-methylpentyl group.

The "n" in formula (1) is preferably an integer of 7 to 20, more preferably 8 to 16, still more preferably 7 to 12, most preferably 9 to 11.

The dialkyl ether represented by formula (1) preferably has 30 or fewer carbon atoms in total in the molecule thereof, more preferably 10 to 25 carbon atoms.

The dialkyl ether of the present invention preferably has an aniline point of 40° C. or higher, more preferably 45 to 90° C. In the case where the aniline point of the dialkyl ether is 40° C. or higher, a sealing part made of plastic material, rubber, or the like does not swell when in contact with the lubricating base oil containing the dialkyl ether. In the case where the aniline point is 90° C. or lower, contraction of such a sealing part is prevented.

The dialkyl ether of the present invention preferably has a flash point of 140° C. or higher, more preferably 150° C. or higher. In the case where the flash point is 140° C. or higher, evaporation of the lubricating base oil containing the dialkyl ether of the present invention is suppressed, thereby prolonging the life of the lubricating oil.

When the kinematic viscosity, as measured at 100° C., is P $mm^2/s$, and the kinematic viscosity, as measured at 40° C., is Q $mm^2/s$, the dialkyl ether of the present invention preferably satisfies the relationship (a) a P of 2.0 $mm^2/s$ or more, and a viscosity index of 130 or higher, or the relationship (b) a P of less than 2.0 $mm^2/s$, and $Q \leq 4.478 \times P - 2.9234$.

The dialkyl ether of the present invention preferably has a kinematic viscosity, as measured at 40° C., of 5.8 $mm^2/s$ or lower, and a kinematic viscosity, as measured at 100° C., of 2.1 $mm^2/s$ or lower.

In addition, the dialkyl ether of the present invention preferably has a pour point of 0° C. or lower, more preferably −30° C. or lower.

[Lubricating Base Oil]

The lubricating base oil of the present invention contains at least one species of the aforementioned dialkyl ethers. Depending on the isolation technique, the lubricating base oil may further contain unreacted raw material and by-products.

The amount of dialkyl ether, with respect to the entire amount of the lubricating base oil of the present invention, is preferably 50 to 100 mass %, more preferably 70 to 100 mass %, still more preferably 80 to 100 mass %, particularly preferably 90 to 100 mass %.

The lubricating base oil of the present invention may further contain, in addition to the aforementioned dialkyl ether, another base oil such as a mineral oil or a hydrocarbon compound.

Examples of the hydrocarbon compound include poly-α-olefin, ethylene-propylene copolymer, esters (monoester, diester, polyester, etc.), polyethers (e.g., polyalkylene glycol), and alkylbenzene. Among them, a high-viscosity poly-α-olefin; specifically, a poly-α-olefin having a kinematic viscosity, as measured at 100° C., of 100 $mm^2/s$ or higher is preferred, and the kinematic viscosity is more preferably 120 $mm^2/s$ or higher, still more preferably 140 $mm^2/s$ or higher. In order to attain low flowability, preferably, the pour point is −40° C. or lower, and the viscosity index is 170 or higher.

The lubricating base oil of the present invention preferably has a kinematic viscosity, as measured at 100° C., of 5.0 $mm^2/s$ or lower, more preferably 4.5 $mm^2/s$ or lower, still more preferably 3.0 $mm^2/s$ or lower, particularly preferably 2.7 $mm^2/s$ or lower, most preferably 2.5 $mm^2/s$ or lower.

The lubricating base oil of the present invention preferably has a viscosity index of 150 or higher, more preferably 170 or higher, still more preferably 190 or higher.

The lubricating base oil of the present invention preferably has a pour point of 0° C. or lower, more preferably −25° C. or lower, still more preferably −30° C. or lower.

When the kinematic viscosity as measured at 100° C., viscosity index, and pour point fall within the aforementioned ranges, low viscosity, low evaporation performance, and energy- and fuel-saving performance can be attained.

EXAMPLES

The present invention will next be described in more detail by way of examples, which should not be construed as limiting the invention thereto.

Example 1

Synthesis of 1-(3,7-dimethyloctoxy)decane

[F4]

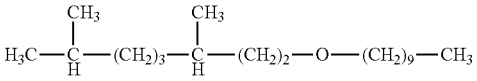

To 2-L glass flask, 158 g of 3,7-dimethyl-1-octanol, 221 g of 1-bromodecane, 32 g of tetrabutylammonium bromide, and 454 g of aqueous sodium hydroxide (236 g of sodium hydroxide dissolved in 218 g of water) were added, and the mixture was allowed to react under stirring at 70° C. for 5 hours.

After completion of reaction, the reaction mixture was transferred to a separating funnel, and the aqueous layer was removed. The remaining organic layer was washed five times with 500 mL of water. The washed organic layer was distilled under reduced pressure, to thereby yield 208 g of 1-(3,7-dimethyloctoxy)decane.

Then, the kinematic viscosity, viscosity index, pour point, aniline point, and flash point of the thus-yielded 1-(3,7-dimethyloctoxy)decane were measured through the following methods. Table 1 shows the results.

(1) Kinematic Viscosity

Measured in accordance with the method described in JIS K2283.

(2) Viscosity Index

Measured in accordance with the method described in JIS K2283.

(3) Pour Point

Measured in accordance with the method described in JIS K2269.

(4) Aniline Point

Measured in accordance with the method described in JIS K2256.

(5) Flash Point

Measured in accordance with the method described in JIS K2265.

Example 2

Synthesis of 1-(3,7-dimethyloctoxy)dodecane

[F5]

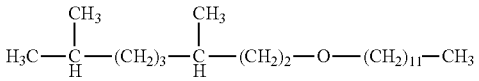

The procedure of Example 1 including reaction and post-treatment was repeated, except that 249 g of 1-bromododecane was used instead of 221 g of 1-bromodecane, to thereby yield 228 g of 1-(3,7-dimethyloctoxy)dodecane. The kinematic viscosity, viscosity index, pour point, aniline point, and flash point of the thus-yielded compound were measured in the same manner as employed in Example 1. Table 1 shows the results.

Example 3

Synthesis of 1-(3,7-dimethyloctoxy)undecane

[F6]

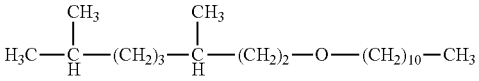

The procedure of Example 1 including reaction and post-treatment was repeated, except that 235 g of 1-bromoundecane was used instead of 221 g of 1-bromodecane, to thereby yield 190 g of 1-(3,7-dimethyloctoxy)undecane. The kinematic viscosity, viscosity index, pour point, aniline point, and flash point of the thus-yielded compound were measured in the same manner as employed in Example 1. Table 1 shows the results.

Example 4

Synthesis of 1-(3,5,5-trimethylhexoxy)dodecane

[F7]

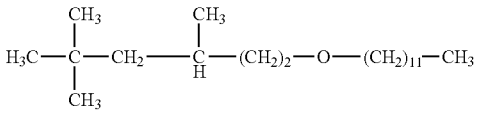

The procedure of Example 1 including reaction and post-treatment was repeated, except that 144 g of 3,5,5-trimethyl-1-hexanol and 249 g of 1-bromododecane were used instead of 158 g of 3,7-dimethyl-1-octanol and 221 g of 1-bromodecane, to thereby yield 225 g of 1-(3,5,5-trimethylhexoxy)dodecane. The kinematic viscosity, viscosity index, pour point, aniline point, and flash point of the thus-yielded compound were measured in the same manner as employed in Example 1. Table 1 shows the results.

Example 5

Synthesis of 1-(3,5,5-trimethylhexoxy)decane

[F8]

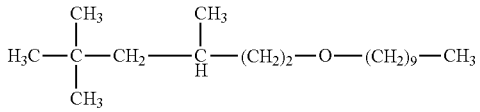

The procedure of Example 1 including reaction and post-treatment was repeated, except that 144 g of 3,5,5-trimethyl-1-hexanol was used instead of 158 g of 3,7-dimethyl-1-octanol, to thereby yield 200 g of 1-(3,5,5-trimethylhexoxy) decane. The kinematic viscosity, viscosity index, pour point, aniline point, and flash point of the thus-yielded compound were measured in the same manner as employed in Example 1. Table 1 shows the results.

Example 6

Synthesis of 1-(3,5,5-trimethylhexoxy)undecane

[F9]

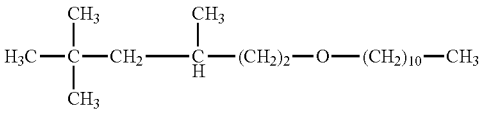

The procedure of Example 1 including reaction and post-treatment was repeated, except that 144 g of 3,5,5-trimethyl-1-hexanol and 235 g of 1-bromoundecane were used instead of 158 g of 3,7-dimethyl-1-octanol and 221 g of 1-bromodecane, to thereby yield 195 g of 1-(3,5,5-trimethylhexoxy) undecane. The kinematic viscosity, viscosity index, pour point, aniline point, and flash point of the thus-yielded compound were measured in the same manner as employed in Example 1. Table 1 shows the results.

Example 7

Synthesis of 1-(3,5,5-trimethylhexoxy)tetradecane

[F10]

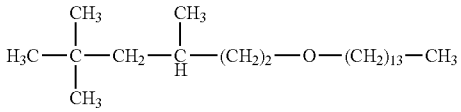

The procedure of Example 1 including reaction and post-treatment was repeated, except that 144 g of 3,5,5-trimethyl-1-hexanol and 277 g of 1-bromotetradecane were used instead of 158 g of 3,7-dimethyl-1-octanol and 221 g of 1-bromodecane, to thereby yield 248 g of 1-(3,5,5-trimethylhexoxy)tetradecane. The kinematic viscosity, viscosity index, pour point, aniline point, and flash point of the thus-yielded compound were measured in the same manner as employed in Example 1. Table 1 shows the results.

Comparative Example 1

Synthesis of 7-(octoxymethyl)pentadecane

[F11]

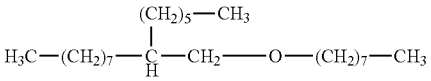

The procedure of Example 1 including reaction and post-treatment was repeated, except that 242 g of 2-hexyl-1-decanol and 193 g of 1-bromooctane were used instead of 158 g of 3,7-dimethyl-1-octanol and 221 g of 1-bromodecane, to thereby yield 230 g of 7-(octoxymethyl)pentadecane. The kinematic viscosity, viscosity index, pour point, aniline point, and flash point of the thus-yielded compound were measured in the same manner as employed in Example 1. Table 1 shows the results.

Comparative Example 2

Evaluation of 7-(decoxymethyl)pentadecane

[F12]

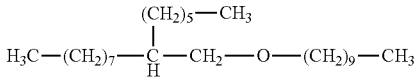

The kinematic viscosity, viscosity index, pour point, aniline point, and flash point of 7-(decoxymethyl)pentadecane, disclosed in Japanese Patent No. 4769463, were measured in the same manner as employed in Example 1. Table 1 shows the results.

Comparative Example 3

Evaluation of 1,3-dimethylbutyl dodecyl ether

The kinematic viscosity, viscosity index, pour point, aniline point, and flash point of 1,3-dimethylbutyl dodecyl ether, used in Examples 1 and 2 of Patent Document 6, were measured in the same manner as employed in Example 1. Table 1 shows the results.

Comparative Example 4

Evaluation of 1,3-dimethylbutyl tetradecyl ether

The kinematic viscosity, viscosity index, pour point, aniline point, and flash point of 1,3-dimethylbutyl tetradecyl ether, used in Examples 3 to 7 of Patent Document 6, were measured in the same manner as employed in Example 1. Table 1 shows the results.

Comparative Example 5

Evaluation of 1-methylpropyl tetradecyl ether

The kinematic viscosity, viscosity index, pour point, aniline point, and flash point of 1-methylpropyl tetradecyl ether, used in Examples 12 and 13 of Patent Document 6, were measured in the same manner as employed in Example 1. Table 1 shows the results.

Comparative Example 6

Evaluation of 1-methylpropyl octadecyl ether

The kinematic viscosity, viscosity index, pour point, aniline point, and flash point of 1-methylpropyl octadecyl ether, used in Example 14 of Patent Document 6, were measured in the same manner as employed in Example 1. Table 1 shows the results.

TABLE 1

| | Kinematic viscosity ($mm^2/s$) | | Viscosity | Pour point | Aniline point | Flash point | Density |
|---|---|---|---|---|---|---|---|
| | 40° C. | 100° C. | index | (° C.) | (° C.) | (° C.) | ($g/cm^3$) |
| Ex. 1 | 4.791 | 1.736 | — | −37.5 | 56.2 | 174 | 0.8172 |
| Ex. 2 | 6.297 | 2.121 | 154 | −22.5 | 65.1 | 192 | 0.8191 |
| Ex. 3 | 5.524 | 1.927 | — | −30 | 60.7 | 182 | 0.8186 |
| Ex. 4 | 5.745 | 2.02 | 169 | −27.5 | 61.8 | 182 | 0.8192 |
| Ex. 5 | 4.289 | 1.629 | — | −40 | 52 | 160 | 0.8164 |
| Ex. 6 | 4.979 | 1.813 | — | −35 | 57.2 | 170 | 0.8164 |
| Ex. 7 | 7.468 | 2.442 | 170 | −15 | 69.8 | 196 | 0.8211 |
| Comp. Ex. 1 | 6.808 | 2.135 | 117 | ≤−50 | 79.5 | 202 | 0.8234 |
| Comp. Ex. 2 | 8.372 | 2.494 | 129 | ≤−45 | 86 | 211 | 0.8283 |
| Comp. Ex. 3 | 3.401 | 1.373 | — | −25 | 45.9 | 157 | 0.8098 |
| Comp. Ex. 4 | 4.531 | 1.706 | — | −15 | 55.7 | 174 | 0.8131 |
| Comp. Ex. 5 | 3.779 | 1.502 | — | −10 | 44.5 | 161 | 0.8122 |
| Comp. Ex. 6 | 6.658 | 2.298 | 187 | 20 | 64 | 195 | 0.8207 |

Example 8

The compound produced in Example 1 and poly-α-olefin (kinematic viscosity at 100° C.: 150 $mm^2/s$) were mixed at a mass ratio of 74:26. The kinematic viscosity, viscosity index, and pour point of the thus-obtained mixture were measured in the same manner as employed in Example 1. Table 2 shows the results.

Example 9

The compound produced in Example 2 and poly-α-olefin used in Example 8 were mixed at a mass ratio of 78:22. The kinematic viscosity, viscosity index, and pour point of the thus-obtained mixture were measured in the same manner as employed in Example 1. Table 2 shows the results.

Example 10

The compound produced in Example 3 and poly-α-olefin used in Example 8 were mixed at a mass ratio of 76:24. The kinematic viscosity, viscosity index, and pour point of the thus-obtained mixture were measured in the same manner as employed in Example 1. Table 2 shows the results.

Example 11

The compound produced in Example 4 and poly-α-olefin used in Example 8 were mixed at a mass ratio of 77:23. The kinematic viscosity, viscosity index, and pour point of the thus-obtained mixture were measured in the same manner as employed in Example 1. Table 2 shows the results.

Example 12

The compound produced in Example 5 and poly-α-olefin used in Example 8 were mixed at a mass ratio of 73:27. The kinematic viscosity, viscosity index, and pour point of the thus-obtained mixture were measured in the same manner as employed in Example 1. Table 2 shows the results.

Comparative Example 7

The compound produced in Comparative Example 3 and poly-α-olefin used in Example 8 were mixed at a mass ratio of 69:31. The kinematic viscosity, viscosity index, and pour point of the thus-obtained mixture were measured in the same manner as employed in Example 1. Table 2 shows the results.

Comparative Example 8

The compound produced in Comparative Example 4 and poly-α-olefin used in Example 8 were mixed at a mass ratio of 73:27. The kinematic viscosity, viscosity index, and pour point of the thus-obtained mixture were measured in the same manner as employed in Example 1. Table 2 shows the results.

Comparative Example 9

The compound produced in Example 5 and poly-α-olefin used in Example 8 were mixed at a mass ratio of 70:30. The kinematic viscosity, viscosity index, and pour point of the thus-obtained mixture were measured in the same manner as employed in Example 1. Table 2 shows the results.

TABLE 2

| | Dialkyl ether | | Poly-α-olefin | Kinematic viscosity | | | Pour |
|---|---|---|---|---|---|---|---|
| | Compound | Content (mass %) | Content (mass %) | ($mm^2/s$) 40° C. | 100° C. | Viscosity index | point (° C.) |
| Ex. 8 | Ex. 1 | 74 | 26 | 15.675 | 4.456 | 220 | ≤−40 |
| Ex. 9 | Ex. 2 | 78 | 22 | 16.562 | 4.537 | 208 | −25 |
| Ex. 10 | Ex. 3 | 76 | 24 | 15.725 | 4.488 | 223 | −30 |
| Ex. 11 | Ex. 4 | 77 | 23 | 15.787 | 4.507 | 223 | −27.5 |
| Ex. 12 | Ex. 5 | 73 | 27 | 15.339 | 4.493 | 233 | ≤−40 |
| Comp. Ex. 7 | Comp. Ex. 3 | 69 | 31 | 15.042 | 4.549 | 249 | −15 |
| Comp. Ex. 8 | Comp. Ex. 4 | 73 | 27 | 15.599 | 4.518 | 230 | −20 |
| Comp. Ex. 9 | Comp. Ex. 5 | 70 | 30 | 15.3 | 4.587 | 247 | −10 |

As is clear from comparison of Examples 1 to 7 with Comparative Examples 1 to 6 shown in Table 1, and from comparison of Examples 8 to 12 with Comparative Examples 7 to 9 shown in Table 2, the dialkyl ethers falling within the scope of the present invention exhibit low viscosity, excellent viscosity-temperature characteristics, and high fluidity at low temperature, which are required of a base oil of a lubricating oil composition.

The dialkyl ether of the present invention exhibits low viscosity, excellent viscosity-temperature characteristics, and high fluidity at low temperature. Thus, the ether is suitably used in a drive system, an internal combustion engine, or the like.

The invention claimed is:

1. A dialkyl ether of formula (1):

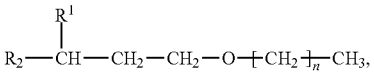

(1)

wherein, in formula (1):

$R^1$ is a C1 to C3 linear-chain alkyl group;

$R^2$ is a C3 to C10 branched alkyl group; and n is an integer of 7 to 12, and wherein the dialkyl ether has a kinematic viscosity, as measured at 100° C., of 2.02 $mm^2/s$ or lower.

2. The dialkyl ether of claim 1, wherein $R^2$ in formula (1) is a 2,2-dimethylpropyl group or a 4-methylpentyl group.

3. The dialkyl ether of claim 1, wherein $R^1$ in formula (1) is a methyl group.

4. The dialkyl ether of claim 3, wherein n in formula (1) is an integer of 9 to 11.

5. The dialkyl ether of claim 1, which has an aniline point of 40° C. or higher.

6. The dialkyl ether of claim 1, which has a flash point of 140° C. or higher.

7. The dialkyl ether of claim 1, which has a pour point of 0° C. or lower.

8. A lubricating base oil, comprising at least one dialkyl ether of claim 1.

9. The lubricating base oil of claim 8, further comprising a hydrocarbon compound.

10. The lubricating base oil of claim 9, wherein the hydrocarbon compound is a poly-α-olefin.

11. A lubricating oil composition, comprising:

the lubricating base oil of claim 8; and an additive.

12. A drive system, comprising the lubricating base oil of claim 8.

13. An internal combustion engine comprising the lubricating base oil of claim 8.

14. The dialkyl ether of claim 1, wherein, in formula (1):

$R^1$ is a methyl group;

$R^2$ is a 2,2-dimethylpropyl group; and n in formula (1) is an integer of 9 to 11.

15. The dialkyl ether of claim 1, wherein, in formula (1):

$R^1$ is a methyl group;

$R^2$ is a 4-methylpentyl group; and n in formula (1) is an integer of 9 to 11.

* * * * *